US005271860A

United States Patent [19]

Schwadtke et al.

[11] Patent Number: 5,271,860

[45] Date of Patent: Dec. 21, 1993

[54] BLEACHING LIQUID DETERGENT

[75] Inventors: Karl Schwadtke, Leverkusen; Eric Sung, Monheim, both of Fed. Rep. of Germany

[73] Assignee: Henkel Kommanditgesellschaft auf Aktien, Duesseldorf, Fed. Rep. of Germany

[21] Appl. No.: 962,234

[22] PCT Filed: Jul. 18, 1991

[86] PCT No.: PCT/EP91/01343

§ 371 Date: Jan. 27, 1993

§ 102(e) Date: Jan. 27, 1993

[87] PCT Pub. No.: WO92/02607

PCT Pub. Date: Feb. 20, 1992

[30] Foreign Application Priority Data

Jul. 27, 1990 [DE] Fed. Rep. of Germany ..... 4023893

[51] Int. Cl.[5] ..... C11D 3/22; C11D 3/395; C11D 10/04; C11D 17/08

[52] U.S. Cl. ..... 252/96; 252/95; 252/104; 252/122; 252/132; 252/173; 252/174.17; 252/174.19; 252/174.21; 252/186.29; 252/550; 252/DIG. 14

[58] Field of Search ..... 252/95, 96, 104, 122, 252/132, 173, 174.17, 174.19, 174.21, 186.29, 550, DIG. 14

[56] References Cited

U.S. PATENT DOCUMENTS

| | | | |
|---|---|---|---|
| 4,470,919 | 9/1984 | Goffinet | 252/102 |
| 4,525,291 | 6/1985 | Smith | 252/95 |
| 4,764,302 | 8/1988 | Baker | 252/95 |
| 4,775,424 | 10/1988 | Wisotzki | 134/42 |

FOREIGN PATENT DOCUMENTS

| | | |
|---|---|---|
| 0037184 | 10/1981 | European Pat. Off. . |
| 0086511 | 8/1983 | European Pat. Off. . |
| 0265041 | 4/1988 | European Pat. Off. . |

*Primary Examiner*—Dennis Albrecht

*Attorney, Agent, or Firm*—Ernest G. Szoke; Wayne C. Jaeschke; Real J. Grandmaison

[57] ABSTRACT

A bleaching liquid detergent composition containing (A) 3 to 9% by weight of a $C_{12-18}$ alkyl sulfate in the form of the sodium or potassium salt, (B) 8 to 20% by weight, based on free fatty acid, of a saturated or unsaturated sodium or potassium soap, (C) 0.3 to 3% by weight of an alkyl glucoside corresponding to the formula $RO(G)_x$, wherein R is a $C_{8-18}$ alkyl radical, G is a glucose unit and x is a number of 1 to 10, (D) 8 to 18% by weight of an ethoxylated $C_{12-18}$ alcohol containing on average 5 to 9 moles ethylene oxide, (E) 2 to 10% by weight hydrogen peroxide, (F) 0.3 to 2% by weight citric acid present as Na or K citrate, and (G) the balance, a solvent mixture consisting of water and monohydric or polyhydric alcohols containing 2 to 6 carbon atoms.

9 Claims, No Drawings

BLEACHING LIQUID DETERGENT

BACKGROUND OF THE INVENTION

1. Field of the Invention

This invention relates to a water-based liquid detergent which contains hydrogen peroxide as bleaching agent and which is distinguished by high stability in storage and easy dosing and by a process for its production.

2. Discussion of Related Art

Both non-aqueous and aqueous liquid detergents containing bleaching per compounds are known. In non-aqueous detergents, the per compounds typically added in the form of solid perhydrates or per salts are generally not difficult to stabilize. However, difficulties are often involved in stabilizing the detergents against separation. These difficulties are normally counteracted by adjusting the detergents to a high viscosity and grinding the ingredients to a very small particle size by an elaborate grinding process carried out in colloid mills. In many cases, sedimentation stabilizers also have to be added. Another disadvantage is that relatively large quantities of inflammable organic solvents often have to be added. Detergents of the type mentioned are described, for example, in DE 12 79 878 (GB 1,205,711), DE 22 33 771 (U.S. Pat. No. 3,850,831), DE 28 25 218 (U.S. Pat. No. 4,316,812) and Ep 30 086.

In water-based liquid detergents, in which the ingredients are dissolved and hence are generally more resistant to phase separation, considerable difficulties are involved in stabilizing oxygen-containing bleaching agents. According to DE 10 80 722, highly condensed phosphates are added to the detergents which are then adjusted to a pH value of 6 to 6.5. On account of their phosphate content, the detergents have a eutrophicating effect in wastewater. In addition, the detergents are paste-like on account of their high percentage content of nonionic surfactants and, accordingly, cannot be measured out with measuring cups, as preferred by consumers. The detergents described in DE 15 67 583 (U.S. Pat. No. 3,658,712) contain a special crosslinked polymer as stabilizer which also thickens the detergents to a considerable extent so that they are difficult to dose. Finally, according to EP 38 101, the particles of bleaching agent are encapsulated and are suspended in the detergent in this form. Unfortunately, there are no details in this document as to the nature of the encapsulating material which, logically, must be stable or rather insoluble in the water-based detergent concentrate, but unstable or rather readily soluble in the aqueous wash liquor.

The problems discussed in the foregoing are solved by the present invention.

DESCRIPTION OF THE INVENTION

The present invention relates to a bleaching liquid detergent containing (A) 3 to 9% by weight of a $C_{12-18}$ alkyl sulfate in the form of the sodium or potassium salt, (B) 8 to 20% by weight (based on free fatty acid) of a saturated and/or unsaturated sodium or potassium soap, (C) 0.3 to 3% by weight of an alkyl glucoside corresponding to the general formula $RO(G)_x$, where R is a $C_{8-18}$ alkyl radical, G is a glucose unit and x is a number of 1 to 10, (D) 8 to 18% by weight of an ethoxylated $C_{12-18}$ alcohol containing on average 5 to 9 ethylene oxide groups, (E) 2 to 10% by weight hydrogen peroxide, (F) 0.3 to 2% by weight citric acid present as Na or K citrate, (G) a solvent mixture consisting of water and monohydric or polyhydric alcohols containing 2 to 6 carbon atoms.

Suitable alkyl sulfates (A) are the sulfuric acid monoesters of $C_{12-18}$ fatty alcohols, such as lauryl, myristyl or cetyl alcohol, more particularly the fatty alcohol mixtures which are obtained from coconut oil, palm oil and palm kernel oil and which may additionally contain unsaturated alcohols, for example oleyl alcohol. Mixtures in which 50 to 70% by weight of the alkyl radicals are $C_{12}$ radicals, 18 to 30% by weight $C_{14}$ radicals, 5 to 15% by weight $C_{16}$ radicals, less than 3% by weight $C_{10}$ radicals and less than 10% by weight $C_{18}$ radicals are preferably used. The percentage content of fatty alkyl sulfates (A) in the detergents is preferably 4 to 8% by weight in the form of the sodium salts.

Preferred soaps (B) are the salts of saturated and unsaturated fatty acids containing 12 to 18 carbon atoms in the form of their mixtures. A preferred soap mixture is formed, for example, from sodium oleate (B1) and the sodium salts of saturated $C_{12-16}$ fatty acid mixtures (B2) in a ratio of 3:1 to 1:3. The percentage content of $C_{12-14}$ fatty acids in component (B2) is best at least 60% by weight and preferably at least 75% by weight (expressed as fatty acid). Suitable fatty acids of this type are, for example, palm kernel oil or coconut oil fatty acids from which the fractions containing 10 carbon atoms and less have largely been removed. As usual with technical grade fatty acid cuts, the oleic acid and the coconut oil fatty acid may also contain stearic acid, but in quantities of at most 20% by weight and preferably less than 15% by weight, based on soap-forming fatty acids. A soap mixture of sodium oleate (B1) and the sodium salt of lauric acid (B2) is also preferred. The ratio by weight of (B1) to (B2) is preferably 2:1 to 1:2. The content of component (B) in the detergent is preferably from 10 to 18% by weight (based on free fatty acid).

Particularly suitable alkyl glucosides (C) are glucosides containing a $C_{8-18}$ alkyl radical, preferably an alkyl radical consisting essentially of $C_{10}$ to $C_{16}$ which is derived from decyl, lauryl myristyl, cetyl and stearyl alcohol and from technical grade fractions preferably containing saturated alcohols. It is particularly preferred to use alkyl glucosides in which the alkyl radical contains 50 to 70% by weight $C_{12}$ and 18 to 30% by weight $C_{14}$. The index x is a number of 1 to 10. It indicates the degree of oligomerization, i.e. the distribution of monoglucosides and oligoglucosides. Whereas x in a given compound must always be an integer and, above all, may assume a value of 1 to 6, the value x for a special product is an analytically determined calculated quantity which is generally a broken number. The average degree of oligomerization x preferably has a value of 1.1 to 3.0 and, more particularly, distinctly below 1.5. A degree of oligomerization of 1.1 to 1.4 is particularly preferred. The percentage content of component (C) is preferably 0.5 to 2% by weight.

Component (D) consists of nonionic surfactants in the form of adducts of 5 to 10 mol ethylene oxide with primary, preferably native $C_{12-18}$ fatty alcohols and mixtures thereof, such as coconut oil, tallow or oleyl alcohols. Ethoxylates of oxoalcohols (alcohols produced by oxo synthesis or hydroformylation) are also suitable. The percentage content of fatty alcohol ethoxylates in the detergents is from 8 to 18% by weight, preferably from 10 to 16% by weight and, more preferably, from 2 to 14% by weight.

The hydrogen peroxide is expressed as 100% $H_2O_2$. Its percentage content is preferably from 3 to 8% by weight and, more preferably, from 3.5 to 6% by weight.

The citric acid is preferably present in the form of the sodium salt. Its percentage content (based on free acid) is preferably from 0.5 to 1% by weight.

In addition to water, the solvent mixture preferably contains an alcohol mixture of monohydric alcohols, such as ethanol or isopropanol, and polyhydric alcohols, such as 1,2-propanediol, butylene glycol, di- or triethylene glycol and glycerol. A mixture of water, ethanol and 1,2-propanediol or a mixture of water, ethanol and glycerol is preferably used. The ethanol content of the detergent is preferably from 4 to 10% by weight and, more particularly, from 5 to 7% by weight. In the case of the polyhydric alcohol, the preferred percentage contents are from 3 to 10% by weight and, more preferably, from 5 to 8% by weight. The remainder (balance to 100% by weight) consists of water. The percentage water content is selected so that non-gelling solutions stable to separation are formed, for which purpose 40 to 50% by weight and preferably 42 to 48% by weight water is generally sufficient. Higher dilution of the detergents with water does not afford any advantages on account of the greater packaging demand involved. The water should be deionized and, in particular, free from heavy metal ions.

In addition, constituents which are not sensitive to oxidation, such as dyes, optical brighteners and opacifiers, may also be present in small quantities. Additional stabilizers are not necessary because the detergents as such show surprisingly high stability in storage. Nevertheless, small amounts, i.e. at most 1% by weight, of stabilizers immune to oxidation, for example phosphonates, such as 1-hydroxyethane-1,1-diphosphonate, ethylenediamine tetra-(methylenephosphonate) and diethylenetriamine penta(methylenephosphonate), in the form of the Na or K salt, or alkylphenols, such as 2,6-ditert. butyl-4-methylphenol, may be present. In a preferred embodiment, phosphonates are used in quantities of 0.5 to 1% by weight and 2,6-ditert. butyl-4-methylphenol is used in quantities of 0.005 to 0.1% by weight and, more particularly, in quantities of 0.005 to 0.05% by weight.

The detergents are adjusted to a pH value in the range from 6.8 to 7.7 and preferably to a pH value in the range from 7.0 to 7.5.

The detergents are stable in storage even in the absence of stabilizers and hydrotropes. The loss of active oxygen after storage for 2 months at room temperature (25° C.) is still less than 3%. In practice, the detergents are distinguished by a good washing and bleaching effect, particularly with respect to colored soil.

The present invention also relates to a process for the production of the liquid detergents described above. The liquid detergents may be produced by methods known per se. The oleic acid and the $C_{12-16}$ fatty acid or the $C_{12-16}$ fatty acid mixture and citric acid are preferably first dissolved while stirring in a mixture of deionized water, sodium hydroxide and 1,2-propanediol preheated to 50°-80° C. and converted into their salts. The remaining constituents of the liquid detergent may be added in any order. The alkyl sulfate is advantageously added before the alkyl glucoside and the fatty alcohol ethoxylate. After cooling of the solution to temperatures below 30° C., the ethanol and the hydrogen peroxide are added, the hydrogen peroxide normally being used in the form of a 25% aqueous hydrogen peroxide solution.

EXAMPLES

The liquid detergents contained the components listed in Table 1 in which:

(A)=sodium fatty alkyl sulfate having a C chain distribution of 1% by weight $C_{10}$, 62% by weight $C_{12}$, 23% by weight $C_{14}$, 11% by weight $C_{16}$, 3% by weight $C_{18}$; the content of free fatty alcohol in the fatty alcohol sulfate was less than 1% by weight, (B1)=oleic acid, technical grade, (B2)=coconut oil fatty acid ($C_{12-18}$), the fatty acid mixture (B1+B2) containing a total of 10% by weight stearic acid, based on the fatty acid mixture, and 12% by weight of the technical grade oleic acid consisting of palmitic acid, (C)=$C_{12-14}$ alkyl glucoside (native base); degree of oligomerization x=1.4, (D)=ethoxylated $C_{12-18}$ alcohol of coconut oil alcohols containing on average 7 ethylene oxide groups, (E)=hydrogen peroxide, (F)=citric acid, (G1)=1,2-propanediol, (G2)=ethanol, (G3)=water, (H)=NaOH, (I)=diethylenetriamine pentamethylene phosphonate (Na salt), (J)=2,6-ditert. butyl-4-methylphenol.

All the constituents (except G3) are taken as water-free.

| Component | Examples 1 | 2 | 3 |
|---|---|---|---|
| A | 6.0 | 5.0 | 6.0 |
| B1 | 7.5 | 6.0 | 7.5 |
| B2 | 6.0 | 8.0 | 6.0 |
| C | 1.5 | 1.5 | 1.5 |
| D | 13.0 | 12.0 | 13.0 |
| E | 4.7 | 5.0 | 4.7 |
| F | 0.7 | 0.5 | 0.7 |
| G1 | 6.5 | 7.0 | 6.5 |
| G2 | 6.0 | 5.0 | 6.0 |
| G3 | 45.6 | 46.7 | 45.59 |
| H | 2.5 | 2.3 | 2.5 |
| I | — | 1.0 | — |
| J | — | — | 0.01 |
| pH value | 7.2 | 7.1 | 7.2 |

The clear liquid detergents were readily pourable. After storage for 8 weeks at room temperature (25° C.), the detergent according to Example 1 had an active oxygen loss (initial content=100%) of 2.2%, the corresponding values for Examples 2 and 3 being 2.1% and 1.9%, respectively. After storage for 8 weeks at 40° C., the detergent according to Example 1 had an active oxygen loss of 13%, the corresponding values for Examples 2 and 3 being 12.5% and 5.7%, respectively.

Textile samples of cotton stained with colored soils were washed with the detergent according to Example 1 at 60° C. and 90° C. in a laboratory washing machine, a detergent in which the hydrogen peroxide had been replaced by water for otherwise the same composition being used for comparison. The washing results were photometrically evaluated at 460 nm (remission differences of 2% and more are significant) and, in addition, were visually evaluated by three examiners (1=stain-free, 6=initial value). The results are set out in the following Tables:

| | Without bleaching agent | With bleaching agent |
|---|---|---|
| Artificial soils on cotton | | |
| % Remission (T = 90° C.) | | |
| Red wine | 58.8 | 66.3 |
| Cocoa | 67.5 | 72.0 |
| Tea | 51.9 | 60.5 |
| Wild berries | 75.3 | 79.8 |
| % Remission (T = 60° C.) | | |
| Red wine | 46.6 | 49.5 |
| Wild berries | 23.6 | 28.3 |
| Natural soils on cotton | | |
| Visual scoring (T = 90° C.) | | |
| Red wine | 1.7 | 1.3 |
| Cocoa | 1.5 | 1.1 |
| Tea | 2.3 | 1.4 |
| Wild berries | 2.3 | 1.3 |
| Visual scoring (T = 60° C.) | | |
| Red wine | 3.6 | 2.9 |
| Cocoa | 1.7 | 1.5 |
| Tea | 2.9 | 2.0 |
| Wild berries | 3.7 | 2.5 |

We claim:

1. A bleaching liquid detergent composition consisting essentially of;

(A) about 3 to about 9% by weight of a $C_{12-18}$ alkyl sulfate in the form of the sodium or potassium salt, (B) about 8 to about 20% by weight, based on free fatty acid, of a saturated or unsaturated sodium or potassium soap, (C) about 0.3 to about 3% by weight of an alkyl glucoside corresponding to the formula $RO(G)_x$, wherein R is a $C_{8-18}$ alkyl radical, G is a glucose unit and x is a number of about 1 to about 10, (D) about 8 to about 18% by weight of an ethoxylated $C_{12-18}$ alcohol containing on average about 5 to about 9 moles ethylene oxide, (E) about 2 to about 10% by weight hydrogen peroxide, (F) about 0.3 to about 2% by weight citric acid present as Na or K citrate, and (G) the balance, a solvent mixture consisting of deionized water and monohydric or olyhydric alcohols containing 2 to 6 carbon atoms, said composition being free of stabilizers that are immune to oxidation.

2. A detergent composition as in claim 1 wherein component (A) comprises a sodium salt of natural fatty alcohol sulfates, and is present in the amount of about 4 to about 8% by weight.

3. A detergent composition as in claim 1 wherein component (B) is present in the amount of about 10 to about 18% by weight, and comprises a soap mixture derived from oleic acid (B1) and saturated $C_{12-16}$ fatty acids (B2) in a weight ratio of (B1) to (B2) of about 3:1 to about 1:3.

4. A detergent composition as in claim 1 wherein component (C) is present in the amount of about 0.5 to about 2% by weight, and in the formula $RO(G)_x$, R is a $C_{10-16}$ alkyl radical and x has a value of about 1.1 to about 3.

5. A detergent composition as in claim 1 wherein component (D) is present in the amount of about 10 to about 16% by weight, and is derived from natural fatty alcohols.

6. A detergent composition as in claim 1 wherein component (E) is present in the amount of about 3 to about 8% by weight.

7. A detergent composition as in claim 1 wherein component (F) is present in the amount of about 0.5 to about 1% by weight, based on citric acid.

8. A detergent composition as in claim 1 wherein the alcohol of component (G) consists of about 4 to about 10% by weight of ethanol or about 3 to about 10% by weight of polyhydric alcohol.

9. The process of producing a bleaching liquid detergent composition free of stabilizers that are immune to oxidation, comprising;

(A) heating to about 50° to about 80° C. a mixture of deionized water, polyhydric alcohol containing 2 to 6 carbon atoms, and sodium hydroxide, (B) dissolving in the mixture prepared in step (A) from about 8 to about 20% by weight of a $C_{12-16}$ fatty acid mixture and from about 0.5 to about 1% by weight of citric acid, (C) adding to the mixture prepared in step (B) from about 3 to about 9% by weight of a $C_{12-18}$ alkyl sulfate, then adding from about 0.3 to about 3% by weight of an alkyl glucoside corresponding to the formula $RO(G)_x$ wherein R is a $C_{8-18}$ alkyl radical, G is a glucose unit and x is a number of about 1 to about 10, then adding from about 8 to about 18% by weight of an ethoxylated $C_{12-18}$ alcohol containing on average about 5 to about 9 moles ethylene oxide, (D) cooling the mixture to a temperature below about 30° C., (E) adding to the mixture a monohydric alcohol and from about 2 to about 10% by weight of hydrogen peroxide, and (F) adjusting the mixture to a pH value of from about 6.8 to about 7.7.

* * * * *